United States Patent [19]

Ishibashi et al.

[11] 4,085,236

[45] Apr. 18, 1978

[54] PROCESS FOR PRODUCING ELECTROSTATIC RECORDING MATERIAL

[75] Inventors: Yoshiyuki Ishibashi; Eijiro Tagami, both of Yokkaichi; Taiji Higaki, Nishinomiya; Takao Matsushita, Kobe, all of Japan

[73] Assignees: Japan Synthetic Rubber Co., Ltd.; Kanzaki Paper Manufacturing Co., Ltd., both of Japan

[21] Appl. No.: 705,820

[22] Filed: Jul. 16, 1976

[30] Foreign Application Priority Data

Jul. 28, 1975 Japan ..... 50-91073

[51] Int. Cl.[2] ..... B05D 5/12; G03G 5/00

[52] U.S. Cl. ..... 427/121; 162/138; 260/42.55; 427/219; 427/220; 427/221; 427/222; 427/385 R

[58] Field of Search ..... 260/42.55, 42.54, 31.8 R; 162/138; 427/58, 121, 219, 220, 221, 222, 385 R, 391, 388 L

[56] References Cited

U.S. PATENT DOCUMENTS

| | | | |
|---|---|---|---|
| 3,057,751 | 10/1962 | Nagle | 260/42.54 |
| 3,104,068 | 9/1963 | Castelli et al. | 260/42.55 |
| 3,427,275 | 2/1969 | Davis et al. | 260/31.8 R |
| 3,847,661 | 11/1974 | Hill et al. | 427/121 |
| 3,944,705 | 3/1974 | Fujioka et al. | 427/121 |
| 3,956,562 | 5/1976 | Shibata et al. | 427/121 |
| 3,956,571 | 5/1971 | Takao et al. | 427/121 |

FOREIGN PATENT DOCUMENTS 1,332,139 10/1973 United Kingdom.

*Primary Examiner*—Ralph S. Kendall
*Assistant Examiner*—John D. Smith
*Attorney, Agent, or Firm*—Craig & Antonelli

[57] ABSTRACT

A process for producing an electrostatic recording material which comprises kneading a hydrophobic pigment having a critical surface tension of 50 dynes/cm or less with an aqueous dispersion of a copolymer consisting of (I) 10 to 50% by weight of methacrylic acid, (II) 5 to 50% by weight of a alkenyl aromatic compound and (III) 30 to 85 % by weight of at least one member selected from the group consisting of conjugated diolefins, alkyl acrylates and alkyl methacrylates; having a glass transition temperature (Tg) of 40° C or less; and having an intrinsic viscosity [$\eta$] of 0.1 to 1.0 dl/g as measured in tetrahydrofuran at 25° C, in a weight ratio of the copolymer to the pigment of 100/20 to 100/200, in the presence of an alkaline material in such a proportion that the viscosity of the aqueous dispersion of the copolymer becomes at least 350 cps, adjusting the viscosity of the aqueous dispersion containing the copolymer and the hydrophobic pigment to 10 to 5,000 cps, coating the resulting coating composition on the surface of an electroconductive base sheet and drying the same. Said process can produce, with a high production efficiency, an electrostatic recording material having a substantially glossless appearance like ordinary paper of office use, being excellent in writability with a pencil and an aqueous ink, stampability and printability, and being capable of recording clear copy images thereon.

25 Claims, No Drawings

PROCESS FOR PRODUCING ELECTROSTATIC RECORDING MATERIAL

This invention relates to a process for producing an electrostatic recording material. In particular, it relates to a process for producing an electrostatic recording material having a glossless recording surface, writability with a pencil and an aqueous ink, stampability, printability and good recording characteristics.

An electrostatic recording material consists basically of a non-electrophoto-conductive, dielectric film layer which is a recording layer, and a low resistance base sheet for supporting the recording layer, and the latent image of electric signal formed on the recording layer is developed with a toner having a polarity opposite to the polarity of the latent image and then subjected to fixing treatment to form a semi-permanent visible image.

In general, the non-electrophoto-conductive dielectric recording layer of such an electrostatic recording material is formed of an insulating polymer. However, when the layer is composed only of an insulating polymer, the insulating polymer forms a substantially continuous film, and hence, the surface of the recording layer is very glossy and unnatural in appearance as compared with ordinary paper of office use. Furthermore, said surface is very smooth and unabsorbable to an aqueous ink or an oily ink. Therefore, said surface is unsatisfactory in writing in pencil, pen, ballpoint pen and the like, printing and marking with a stamp. These disadvantages are very undesirable for an electrostatic recording material intended to be used for general purpose.

In order to remove the above-mentioned disadvantages, some proposals have hitherto been made. However, no improvements satisfactory in practice have been obtained, because the improvements are accompanied by further disadvantages. For example, a method is known for improving the writing adaptability and marking adaptability and reducing the gloss of the recording surface by incorporating, into an insulating resin constituting the recording layer, an inorganic fine powder such as barium sulfate, colloidal silica, titanium dioxide, zinc oxide, aluminum hydroxide, calcium carbonate, or the like, or an organic fine powder such as natural cellulose pulp, starch or the like to roughen the surface of the recording layer. However, in this case, if an electrophoto-conductive powder, such as zinc oxide or titanium dioxide, is incorporated, there is a fear that the electrostatic characteristics of the recording layer may be greatly deteriorated even by an indirect light. Moreover, the incorporation of such a powder results in a reduction of the insulating property of the recording layer, and in an increase of the moisture absorption, whereby the electrostatic characteristics of the resulting recording layer is greatly deteriorated. In particular, at a high humidity, the reduction in image density is very great, and the image density becomes below the practical level. The extent of these disadvantages is varied depending upon the kind of the inorganic or organic fine powder; however such a tendency cannot be avoided.

Recently, it has not been desired to prepare the coating composition for forming the recording layer in the form of an ordinary solvent solution from the standpoint of inflammability, toxicity, workability and economy. Therefore, research has been made on the preparation of the coating composition in the form of an aqueous dispersion. However, when the coating composition for forming the recording layer is prepared in the form of an aqueous dispersion, said inorganic or organic fine powder tends to hold water absorbed, and the electrostatic characteristics are much more deteriorated.

In order to prevent the deterioration of the electrostatic characteristics, it has been proposed to incorporate, into the insulating resin constituting the recording layer, fine powder coated with rosin, shellac, wax, polyvinyl chloride, polyacrylate, polystyrene, polyethylene or the like, or a fine powder coated with an organopolysiloxane as disclosed in U.S. Pat. No. 3,944,705 and the like. In particular, when the fine powder coated with the organopolysiloxane is applied, there is obtained an excellent effect on improvement of the electrostatic characteristics.

In order to maintain in a high level the flowability, mechanical stability and thermal stability of a coating composition, by dispersing the hydrophobic fine powder having coated thereon the above-mentioned material uniformly and stably in the aqueous coating composition and to carry out a smooth coating by use of the coating composition, a further improvement is required. In general, it is known that a dispersing agent is used to disperse various pigment powders in an aqueous coating composition. However, in the case of an electrostatic recording material, the amount of dispersing agent necessary for obtaining a stable dispersion often impairs the dielectric property of the recording layer, and hence, it is more difficult to prepare an aqueous coating composition in which the hydrophobic fine powder is dispersed uniformly and stably.

The present inventors have disclosed in British Patent No. 1,332,139 and Japanese Patent No. 741,752 that they have succeeded in obtaining a polymer applicable to an aqueous coating composition capable of giving an electrostatic recording material having very good recording characteristics, being excellent in mechanical and thermal stability and being free from the disadvantages possessed by the organic solvent type coating composition, such as inflammability, toxicity, low workability and high cost. They have now further found a method for preparing efficiently an aqueous coating composition in which a hydrophobic pigment is dispersed very uniformly and stably by further improving the above-mentioned polymer and combining the polymer with the specific hydrophobic pigment. By applying this method to an electrostatic recording material, there have been invented a process for producing an electrostatic recording material free from the disadvantages possessed by conventional electrostatic recording materials as mentioned above.

The object of this invention is to provide a process for producing an electrostatic recording material with a very high production efficiency, said electrostatic recording material having a substantially glossless appearance like ordinary paper of office use, being excellent in writability in pencil, aqueous ink, or the like, stampability, printability and the like, and being capable of recording a clear copy of image thereon.

According to this invention, there is provided a process for producing an electrostatic recording material, which comprises kneading a hydrophobic pigment having a critical surface tension of 50 dynes/cm or less with an aqueous dispersion of a copolymer consisting of (I) 10 to 50% by weight of methacrylic acid, (II) 5 to 50% by weight of an alkenyl aromatic compound and (III) 30 to 85% by weight of at least one member selected from the group consisting of conjugated diolefins, alkyl acrylates and alkyl methacrylates, having a glass transition temperature (Tg) of 40° C or less and having an intrinsic viscosity [η] of 0.1 to 1.0 dl/g as measured in tetrahydrofuran at 25° C, in a weight ratio of the copolymer to the pigment of 100/20 to 100/200, in the presence of an alkaline material in such an amount that the viscosity of the aqueous dispersion becomes at least 350 cps, adjusting the viscosity of the aqueous dispersion containing the copolymer and the hydrophobic pigment to a value of 10 to 5,000 cps, and then applying the resulting coating composition to the surface of an electrically conductive base sheet and drying the same.

The alkenyl aromatic compound used in this invention includes, for example, styrene, vinyltoluene, dimethylstyrene, halogenated styrene, and α-methylstyrene, and styrene is particularly preferable.

The conjugated diolefins include, for example, butadiene, isoprene, chloroprene, piperylene, cyclopentadiene and the like, and these may be used alone or in combination. Butadiene is particularly preferable. The alkyl acrylates and methacrylates are preferably those having 1 to 12 carbon atoms in the alkyl group, such as ethyl acrylate, butyl acrylate, methyl methacrylate, butyl methacrylate and the like, and these may be used alone or in combination. Particularly preferable is methyl methacrylate. The conjugated diolefin, the alkyl acrylate and the alkyl methacrylate may also be used in combination. It is particularly preferable to use the alkyl acrylate or methacrylate, particularly methyl methacrylate, along with butadiene.

When the carboxyl group content of the copolymer used in this invention is too high, the recording characteristics of the recording material is deteriorated, and hence, the methacrylic acid content of the copolymer is 10 to 50% by weight in practice, and preferably 10 to 30% by weight. When it is less than 10% by weight, a good pigment-dispersing effect is not obtained, and when it is more than 50% by weight, the recording characteristics at a high humidity are lowered. Further, it is desirable that the proportion of the alkenyl aromatic compound is 5 to 50% by weight, particularly 5 to 35% by weight, in view of the film-formability of the recording layer, the background in recording, and the electrical characteristics. When it is less than 5% by weight, a sufficient image density is not obtained, and when it is more than 50% by weight, the recording material is difficult to use because the background is increased in recording and the recording material is curled. Considering the strength and recording characteristics of the recording layer, at least one member selected from the group consisting of conjugated diolefins, alkyl acrylates and alkyl methacrylates is used together with the above-mentioned methacrylic acid and alkenyl aromatic compound, and in this case, the use of an excess of said at least one member adversely affects the recording characteristics, and hence, the amount of said member is 30 to 85% by weight.

In this invention, the copolymer is required to have a glass transition temperature (Tg) not exceeding 40° C from the standpoint of the curling of recording material and the fixing of the toner for development. The term "glass transition temperature" used herein means the temperature determined by calculation from the following equation:

$$1/Tg_0 = W_1/Tg_1 + W_2/Tg_2 + \ldots$$

wherein $Tg_0$ is a glass transition temperature of the copolymer expressed by absolute temperature; $Tg_1$, $Tg_2$, . . . are glass transition temperatures of homopolymers of monomers 1, 2, . . . , respectively, expressed by absolute temperature; $W_1$, $W_2$, . . . are weight fractions of the respective monomers in the copolymer; and $Tg_0 = (Tg + 273)°$ K. As the glass transition temperatures of homopolymers, there are used the following values: polybutadiene: −85° C (188° K), polystyrene: 100° C (373° K), polymethyl methacrylate: 105° C (378° K), polybutyl methacrylate: 20° C (293° K), polybutyl acrylate: −55° C (218° K), polymethacrylic acid: 185° C (458° K), and the like. In order to disperse the hydrophobic pigment uniformly and stably in the aqueous dispersion, the copolymer of this invention is required to have an intrinsic viscosity [η] of 0.1 to 1.0 dl/g, preferably as measured in tetrahydrofuran at 25° C. When the intrinsic viscosity is less than 0.1 dl/g, a sufficient viscosity-increasing effect is not obtained by adding an alkaline material, and hence, the dispersibility of the pigment is poor. When the intrinsic viscosity is more than 1.0 dl/g, the flow property of the aqueous dispersion to which an alkaline material has been added is inferior, and hence, it is impossible to uniformly disperse the pigment in the aqueous dispersion.

The present copolymer is prepared by emulsion-polymerizing or solution-polymerizing the above-mentioned monomers, and the emulsion-polymerization is preferable because the dispersion obtained has a high solids concentration and a low viscosity, and hence, the transportation cost is low and the handling of the dispersion in the preparation of a coating composition is easy. In addition, the preparation of a low viscosity coating composition having a high concentration and an excellent flow property enables the use of coating devices such as blade coater and roll coater which have hitherto been considered to be difficult to use in the step of coating the base sheet therewith. This is very advantageous. When the present aqueous copolymer dispersion is prepared by an emulsion-polymerization, the above-mentioned monomers may be polymerized in an aqueous medium in the presence of a polymerization initiator in the presence or absence of an emulsifier, a chain transfer agent, etc., and it is preferable to effect the polymerization with the following recipe:

| | | Particularly preferable |
|---|---|---|
| Monomer | 100 parts by weight | 100 parts by weight |
| Emulsifier | 0 to 6 parts by weight | 0.1 to 3 parts by weight |
| Initiator | 0.1 to 2 parts by weight | 0.2 to 1 parts by weight |
| Chain transfer agent | 0 to 5 parts by weight | 0 to 3 parts by weight |
| Ion exchanged water | 80 to 300 parts by weight | 100 to 250 parts by weight |
| Polymerization temperature | 30 to 90° C | 40 to 80° C |

As the emulsifier, there may be used anionic and nonionic emulsifiers, and the anionic emulsifiers are preferably ammonium or organic amine salts of alkyl sulfates, alkylaryl sulfonic acids, and sulfosuccinates. The nonionic emulsifiers may be those which are generally used such as polyoxyethylene alkyl ethers, polyoxyethylene aryl ethers, polyoxyethylene alkyl esters, polyoxyethylene aryl esters, block copolymers of polyoxyethylene and polyoxypropylene, and the like.

As the polymerization initiator, there may be used those for general emulsion-polymerization, such as inorganic persulfate compounds, for example, ammonium persulfate; peroxides, for example, hydrogen peroxide; organic hydroperoxides, for example, cumene hydroperoxide; organic peroxides, for example, benzoyl peroxide; and free radical generators, for example, azobisisobutyronitrile.

As the chain transfer agent, there may be used alkyl mercaptans, such as octyl mercaptan, dodecyl mercaptan, hexadecyl mercaptan and the like, the halogenated hydrocarbons such as carbon tetrachloride, trichlorobromomethane, and the like.

The polymerization method may be either batchwise or continuous, and the monomers may be added all at one time or a part of the monomers may be added on the way of polymerization.

When the present copolymer is prepared by solution-polymerization, the above-mentioned monomers may be polymerized in an organic solvent in the presence of a polymerization initiator, a chain transfer agent and the like, and it is preferable to effect the polymerization with the following recipe:

| | | Particularly preferable |
|---|---|---|
| Monomer | 100 parts by weight | 100 parts by weight |
| Initiator | 0.1 to 5 parts by weight | 0.5 to 5 parts by weight |
| Chain transfer agent | 0 to 5 parts by weight | 0 to 3 parts by weight |
| Organic solvent | 40 to 200 parts by weight | 40 to 100 parts by weight |
| Polymerization temperature | 30 to 100° C | 50 to 90° C |

As the polymerization initiator, there may preferably be used azo type initiators such as azobisisobutyronitrile, azobisdimethylvaleronitrile or the like, organic peroxides such as benzoyl peroxide, lauroyl peroxide and the like. As the chain transfer agent, there may be used the same as those mentioned above for the emulsion-polymerization.

As the organic solvent, there may be used lower alkyl alcohols such as methanol, ethanol, isopropanol and the like; ketones such as methyl ethyl ketone, methyl isobutyl ketone and the like; and aromatic hydrocarbons such as benzene, toluene and the like, and said alcohols are particularly preferable.

It is preferable that the copolymer prepared by polymerization in an organic solvent is partially neutralized with ammonia or an organic amine in an amount not more than the equivalent to the methacrylic acid content of the copolymer and is dispersed in the aqueous medium.

As the hydrophobic pigment used in the present invention, there may be exemplified non-electrophotoconductive inorganic fine powder such as silicic acid; silicates; polyvalent metal carbonates such as calcium carbonate, magnesium carbonate and the like; polyvalent metal sulfates such as barium sulfate, calcium sulfate and the like; polyvalent metal hydroxides such as aluminum hydroxide, barium hydroxide, magnesium hydroxide and the like; polyvalent metal oxides such as aluminum oxide, magnesium oxide and the like; quartz sand; natural clay; and treated clay such as calcined clay and the like, coated or impregnated with various natural and synthetic hydrophobic materials such as fats, rosin, shellac, waxes, salts of higher fatty acids such as calcium oleate, magnesium stearate and the like, synthetic resins such as polyvinyl chloride, polyacrylates, polystyrene, polyethylene and the like, silicone resins such as organopolysiloxane, phenol resins, urea resins, melamine resins, epoxy resins, alkyd resins, and the like. Treated electrophoto-conductive metal oxides or sulfides such as zinc oxide, titanium oxide, cadmium sulfide, lead sulfide, etc., are not applicable because they deteriorate the electrostatic characteristics of the recording layer.

Such hydrophobic pigments are required to have a critical surface tension of 50 dynes/cm or less as measured by the Zisman determination method (see pages 19 to 20 of "Kobunshi no Hyomen Kagaku" (Surface Chemistry of High Polymer) published by Sangyo Tosho, Japan). When the critical surface tension is more than 50 dynes/cm, the recording characteristics are greatly deteriorated, and in particular, the reduction of the image density at a high humidity is remarkable.

Among the above-mentioned various hydrophobic pigments, there are particularly preferable those obtained by treating calcium carbonate, barium sulfate, aluminum oxide, natural clay and treated clay with various hydrophobic materials, which are most preferably silicone resins such as organopolysiloxane and the like.

The amount of the hydrophobic pigment used may vary depending upon the particle size, shape and kind of the pigment. When the amount is less than 20 parts by weight per 100 parts by weight of the copolymer, a sufficient improving effect is not obtained on making the recording material glossless, and on the writability and printability of the recording material. When the amount is more than 200 parts by weight, the electrostatic characteristics of the recording material are deteriorated. Therefore, the amount ranges from 20 to 200 parts by weight, preferably from 40 to 150 parts by weight, per 100 parts by weight of the copolymer.

One of the characteristics of this invention lies in increasing the viscosity of the aqueous copolymer dispersion by addition of an alkaline material such as ammonia or an amine in kneading the dispersion with the hydrophobic pigment, thereby enabling the dispersion and the pigment to be kneaded at a relatively high viscosity and allowing the mechanical dispersing force of the mixer to act very effectively.

Thus, the hydrophobic pigment, which is poor in dispersibility in an aqueous coating composition, is dispersed very efficiently, uniformly and stably, and hence, there is obtained an aqueous coating composition, excellent in flowability, mechanical stability, and thermal stability and capable of being smoothly coated.

As the mixer for kneading of aqueous copolymer dispersion with the hydrophobic pigment, there may be used a vertical type mixer, a horizontal type mixer, a roll type mixer, a blender, an edge runner, a continuous type mixer and the like, which are suitable for kneading plastic solids or viscous liquids, but there cannot be used agitators for relatively low viscosity liquids such as a propeller mixer, stirrer or the like, because said agitators have no action of kneading the whole of the system though have a stirring action. More specifically, various mixers as disclosed on pages 19 - 14 to 19 - 26 of Perry and Chilton, Chemical Engineers' Handbook, 5th edition may be used, and the vertical type mixer includes stationary tank mixers, such as gate mixers, shear-bar mixers, helical-blade mixers and the like; change-can mixers and the like, and the horizontal type mixer includes double-arm kneading mixers such as sigma-blade mixer, single-curve blade mixer, screw-discharge batch mixers and the like; intensive mixers such as banbury mixer; and the like. The continuous type mixer includes single-screw extruders, twin-screw continuous mixers and the like.

In practicing the present invention, as the effective alkaline materials for increasing the viscosity, ammonia is most preferable in view of cost, though there may be used primary, secondary and tertiary aliphatic amines such as ethylamine, propylamine, butylamine, diisopropylamine, triethylamine, etc.; and heterocyclic amines, such as morpholine, etc., and water-soluble amines having a boiling point of 140° C or less, preferably 100° C or less are used, because in the drying step after coating, the amines are volatilized off from the coating in the oven to form a good recording layer.

The amount of the alkaline material used may appropriately be varied depending upon the kind of the aqueous copolymer dispersion or the hydrophobic pigment and the amount thereof, though the amount is such that the viscosity of the aqueous copolymer dispersion may become at least 350 cps. When the viscosity of the aqueous copolymer dispersion is less than 350 cps, it is impossible to efficiently apply the mechanical dispersing force of the mixer to the dispersion of the hydrophobic pigment, and hence, no satisfactory result is obtained. However, when the viscosity of the aqueous dispersion is too high, it takes to much time to disperse the pigment and the viscosity of the coating composition after dispersion increases. Therefore, in general, the viscosity is preferably increased to 10,000 cps or less. The more preferable range of viscosity of the aqueous copolymer dispersion is from 500 to 8,000 cps, and the most preferable range is from 1,000 to 5,000.

The method of adding the alkaline material for controlling the viscosity of the aqueous copolymer dispersion to at least 350 cps is not particularly limited, though, generally, there is used a method by which the alkaline material is added to the aqueous copolymer dispersion prior to kneading the aqueous copolymer dispersion with the hydrophobic pigment in the mixer to increase the viscosity of the aqueous copolymer dispersion, and then the hydrophobic pigment is added and kneaded, or a method by which the alkaline material is added while kneading the aqueous copolymer dispersion with the hydrophobic pigment.

The aqueous copolymer dispersion containing the pigment dispersed uniformly and stably therein obtained by kneading the dispersion with the pigment in the mixer, is subjected to adjustment of the viscosity thereof to a value in the range of 10 to 5,000 cps in order to make the resulting coating composition applicable to various coating devices. When the viscosity is less than 10 cps, the desired spread cannot be obtained, and when it is more than 5,000 cps, the flowability of the coating composition is reduced to make the coating operation difficult.

The adjustment of the viscosity of the aqueous copolymer dispersion containing the pigment is, generally effected by adding diluent water, though a part of the aqueous copolymer dispersion may be post-added or the alkaline material may be added to adjust the viscosity. In particular, a method of adjusting the viscosity by post-adding a partial neutralization product of the copolymer used in this invention is preferable because a coating composition having a high solids concentration is obtained thereby.

To the aqueous coating composition of this invention may be added an auxiliary pigment-dispersing agent such as phosphate, PVA, CMC, gum arabic and the like; a plasticizer; a dyestuff; an anti-foaming agent; and the like in such an amount that the recording characteristics are not deteriorated. Latexes of other type than the above aqueous copolymer dispersion may further be added for improving the toner-fixability, curl-controlling, eliminating frictional static charge, and the like, in such an amount that the recording characteristics are not deteriorated.

In coating a base sheet with the present aqueous copolymer dispersion containing dispersed therein the hydrophobic pigment, there can be utilized a coating device which is often used for aqueous coatings, such as air-knife coater, a roll coater, a blade coater and the like, and the amount of the dispersion applied is adjusted so that the thickness of the dried coating film formed on the base sheet becomes 2 to 20 microns.

As the base sheet, there may be used suitable materials such as paper, plastic sheet (synthetic paper, plastic film or the like), metal foil and the like, though paper is most generally used from the standpoint of low cost and easy processing. The base sheet is required to have an appropriate physical strength, smoothness, elongatability, shrinkability, whiteness, bulkiness and thickness, and generally, it is necessary for the base sheet to have an electroconductivity corresponding to a surface resistivity of about $10^5$ to $10^{11}\Omega$ at a relative humidity of 10 to 90%. Therefore, in the case of a paper base sheet, which is most often used, it is usual to subject the paper to low-resistance-treatment such as impregnating or coating with an inorganic salt, fine powder of carbon black, aluminum, copper, nickel or the like, or a polyelectrolyte.

The electrostatic recording material of this invention is not only used in a system for impressing signal charges directly onto a surface of a dielectric material layer, but also practically applicable as a charge receptor medium (charge-retentive layer) in the so-called method of transfer of electrostatic images wherein electrostatic images formed on a master plate are transferred to another charge-retentive layer, developed and recorded. As such a method of transfer of electrostatic image, there has been known, for example, a method for transferring electrostatic images formed on the master plate to a charge-retentive layer by applying an electric field thereto or forming a short circuit between them. The values of electric resistance of the base sheet of the charge receptor medium used in such a method of transfer of electrostatic images can take a wider range than that of the system for directly impressing electrical signals. For example, in the case of the paper base sheet, the ordinary quality paper may be used as it is without any treatment with said electroconductivity-improving agent.

This invention is explained in more detail below, referring to Examples, which are only by way of illustration and not by way of limitation.

EXAMPLE 1

Synthesis of aqueous copolymer dispersion

In a 100-liter autoclave provided with a stirrer, a jacket, and a cooling coil were charged 7.5 kg of butadiene, 2.5 kg of styrene, 10 kg of methyl methacrylate, 5 kg of methacrylic acid, 375 g of tert.-dodecyl mercaptan, 125 g of ammonium persulfate, 500 g of ammonium salt of lauryl alcohol sulfate and 50 kg of ion-exchanged water, and the resulting mixture was subjected to polymerization at 60° C for 5 hours.

The polymerization conversion was 100%, the glass transition temperature (Tg) of the resulting copolymer was 25° C, the [η] as measured in tetrahydrofuran at 25° C was 0.43 dl/g, and the viscosity was 10 cps.

Production of electrostatic recording material

To 50 kg of a 25% by weight aqueous dispersion of the above-mentioned copolymer was added 1.25 kg of a 28% by weight ammonia water, and the resulting mixture was stirred to mix the same. The viscosity of the resulting aqueous dispersion was 1,000 cps as measured by a BM type viscometer (#4 roter) at 60 rpm. at 25° C. To the aqueous dispersion was added 12.5 kg of a hydrophobic pigment prepared by coating calcined kaolin with a silicone resin (Shinetsu Silicone KS-770, a trade name of Shinetsu Silicone, Japan) and having a critical surface tension of 30 dynes/cm, and they were kneaded by means of a sigma-blade type double arm kneading mixer for 20 minutes. The thus obtained coating composition had a solids concentration of 40% by weight and a viscosity at 25° C of 2,000 cps.

The thus prepared coating composition was coated by means of a doctor blade coater on the surface of a paper having a thickness of 55 microns which had been made low resistant by impregnation with a polyvinylbenzyltrimethylammonium chloride and then dried with hot air at 120° C to form a dried coating film having a thickness of 6 microns.

The surface resistivity of the resulting electrostatic recording material was $5 \times 10^{12}$ ohms at 20° C, 60% RH, DC 100V.

An electrical latent image was formed on a zinc oxide-coated photosensitive paper for electrophotography by an electrophotographic technique, the paper was put on the above electrostatic recording material, the backs of the two were short circuited, and the electrostatic recording material was developed with a liquid developing agent (toner) to obtain a good visible image.

Further, using an electrode in the form of a letter, a high-voltage pulse signal (−1,000 V, 50 microseconds) was impressed to the electrostatic recording material obtained in the present Example, and then subjected to magnetic brush development with a toner for negative charge development to obtain a recorded image having a very good contrast.

The surface of the recording layer of the electrostatic recording material obtained in the present Example had a substantially glossless appearance like ordinary paper for office use, was excellent in writability with a pencil, an aqueous ink or the like, stampability and printability.

COMPARATIVE EXAMPLE 1

To 50 kg of the aqueous copolymer dispersion having a 25% by weight concentration obtained in Example 1 was added 500 g of a 28% by weight ammonia water, and the two were mixed with thorough stirring. The viscosity of the resulting aqueous dispersion was 300 cps at 25° C.

The same hydrophobic pigment as in Example 1 was added to the resulting aqueous dispersion in the same manner as in Example 1, and the resulting mixture was kneaded by means of a kneading mixer to prepare a coating composition. However, the pigment was not uniformly dispersed in the coating composition. An electrostatic recording paper was prepared by use of this coating composition in the same manner as in Example 1. However, only an image remarkable in dot omission was obtained.

EXAMPLE 2

Synthesis of aqueous copolymer dispersion

In an autoclave were charged 30 parts by weight of butadiene, 10 parts by weight of styrene, 45 parts by weight of methyl methacrylate, 15 parts by weight of methacrylic acid, 4 parts by weight of azobisisobutyronitrile and 50 parts by weight of methanol, and the resulting mixture was subjected to polymerization at 60° to 75° C for 24 hours.

The polymerization conversion was 98%, the glass transition temperature (Tg) of the resulting copolymer was 23° C, and [η] was 0.18 dl/g as measured in tetrahydrofuran at 25° C.

To a methanol solution of the resulting copolymer were added 350 parts by weight of water and 8 parts by weight of a 28% by weight ammonia water, and the resulting mixture was thoroughly mixed with stirring to obtain an aqueous dispersion having a solids concentration of 20% by weight and a viscosity of 150 cps.

Production of electrostatic recording material

To 100 parts by weight of the thus obtained aqueous dispersion was added 1.5 parts by weight of a 28% by weight of ammonia water, and the resulting mixture was thoroughly mixed with stirring to obtain a viscosity of 5,000 cps at 25° C. To the dispersion was added 20 parts by weight of a hydrophobic pigment having a critical surface tension of 45 dynes/cm obtained by coating calcium carbonate with a silicone varnish (Shinetsu Silicone KR 275, a trade name of Shinetsu Silicone, Japan), and the resulting mixture was kneaded by means of a change-can mixer for 30 minutes. The mixture was diluted with water to a solids concentration of 30% by weight and the viscosity thereof was adjusted to 120 cps at 25° C. The thus prepared coating composition was coated on the surface of the same base paper as in Example 1 by means of an air-knife coater, and then dried with hot air at 120° C to obtain a dried coating film having a thickness of 5 microns.

The surface of the recording layer of the thus obtained electrostatic recording material had a substantially glossless appearance like ordinary paper for office use, and was excellent in writability with a pencil, an aqueous ink or the like, stampability and printability. When the recording material was subjected to recording in the same manner as in Example 1 to obtain a good recorded image.

EXAMPLE 3

The following experiments were carried out in order to clarify the effect of the amount of methacrylic acid.

In an autoclave were charged 100 parts by weight, in total, of the monomers shown in Table 1, 2.0 parts by weight of an ammonium salt of lauryl alcohol sulfate, 0.5 part by weight of ammonium persulfate, 2.0 parts by weight of tert.-dodecyl mercaptan and 200 parts by weight of ion-exchanged water, and the resulting mixture was subjected to polymerization at 60° C for 18 hours. An electrostatic recording material was prepared in the same manner as in Example 1, except that an appropriate amount of ammonia was added to the aqueous copolymer dispersion to adjust the viscosity thereof to 1,000 cps and that a hydrophobic pigment having a critical surface tension of 40 dynes/cm obtained by coating silicic anhydride with a silicone oil (Toray Silicone SH1107 Oil, a trade name of Toray Silicone, Japan) was substituted for the hydrophobic pigment. The results obtained are shown in Table 1.

As is clear from Table 1, when the amount of methacrylic acid is less than 10% by weight, the hydrophobic pigment cannot be uniformly dispersed in the coating composition, and the surface of the recording layer of the resulting recording material has an uneven smoothness. When the recording material was subjected to recording, only an image with remarkable dot omission was obtained. Moreover, when the amount of methacrylic acid is more than 50% by weight, the recording characteristics are deteriorated and the fixing of image is remarkably low.

Table 1

| Run No. | 1* | 2 | 3 | 4 | 5 | 6 | 7* |
|---|---|---|---|---|---|---|---|
| Monomer composition (% by weight) | | | | | | | |
| Butadiene | 30 | 30 | 30 | 30 | 30 | 30 | 30 |
| Styrene | 10 | 10 | 10 | 10 | 10 | 10 | 10 |
| Methyl methacrylate | 52 | 50 | 40 | 30 | 20 | 10 | — |
| Methacrylic acid | 8 | 10 | 20 | 30 | 40 | 50 | 60 |
| Conversion (%) | 99 | 99 | 99 | 99 | 100 | 99 | 99 |
| Glass transistion temp. (° C) | 20 | 21 | 25 | 29 | 33 | 38 | 42 |
| Intrinsic viscosity [η](dl/g) | 0.38 | 0.38 | 0.39 | 0.38 | 0.38 | 0.37 | 0.38 |
| Dispersibility of pigment | 2 | 4 | 5 | 5 | 5 | 5 | 5 |
| Recording characteristics | 2 | 4 | 5 | 5 | 3 | 3 | 1 |
| Curl and fixing | 5 | 5 | 5 | 4 | 4 | 3 | 1 |
| Similarity to natural paper | 5 | 5 | 5 | 5 | 5 | 5 | 5 |
| Writability | 5 | 5 | 5 | 5 | 5 | 5 | 5 |

Note:
*Comparison
Rating was effected on the following five grades:
5 . . . Excellent
4 . . . Good
3 . . . Fairly good
2 . . . Poor
1 . . . Unusable

EXAMPLE 4

The following experiments were conducted to examine the effect of the amount of the hydrophobic pigment on the recording characteristics and the appearance and writability of the surface of recording layer.

Various electrostatic recording materials were prepared in the same manner as in Example 1, except that a hydrophobic pigment having a critical surface tension of 40 dynes/cm obtained by coating calcined kaolin with a silicone resin (Syl-off 23, a trade name of Dow Corning, U.S.A.) in an amount as shown in Table 2 was substituted for the hydrophobic pigment. The characteristics of the resulting electrostatic recording material are shown in Table 2.

As is clear from Table 2, when the amount of thy hydrophobic pigment is less than 20 parts by weight per 100 parts by weight of the copolymer, the recording material has a very unnatural surface gloss, and is inferior in writability. When the amount of the hydrophobic pigment is more than 200 parts by weight per 100 parts by weight of the copolymer, the recording characteristics are greatly deteriorated.

Table 2

| Run No. | 1* | 2* | 3 | 4 | 5 | 6* |
|---|---|---|---|---|---|---|
| Copolymer (parts by weight as solids) | 100 | 100 | 100 | 100 | 100 | 100 |
| Hydrophobic pigment (parts by weight as solids) | 0 | 10 | 20 | 100 | 200 | 250 |
| Recording characteristics | 5 | 5 | 5 | 5 | 3 | 1 |
| Curl and fixing | 4 | 4 | 5 | 5 | 5 | 3 |
| Similarity to natural paper | 1 | 2 | 3 | 5 | 5 | 5 |
| Writability | 1 | 2 | 3 | 5 | 5 | 5 |

Note:
*Comparison

EXAMPLE 5

Experiments as shown in Table 3 were conducted on various pigments. That is to say, the same procedure as in Example 1 was repeated, except that various pigments were substituted for the hydrophobic pigment, to produce various electrostatic recording materials. The results obtained are shown in Table 3.

As shown in Table 3, when hydrophobic pigments having a critical surface tension of more than 50 dynes/cm or hydrophilic pigments are used, the deterioration of recording characteristics is great, and in particular, the reduction of image density at a high humidity is great.

Table 3

| Pigment No. | 1 | 2 | 3 | 4* | 5* |
|---|---|---|---|---|---|
| Critical surface tension (dynes/cm) | 30 | 40 | 45 | 60 | 65 |
| Recording characteristics | 5 | 5 | 4 | 1 | 1 |
| Curl and fixing | 5 | 5 | 5 | 2 | 4 |
| Similarity to natural paper | 5 | 4 | 4 | 4 | 5 |
| Writability | 5 | 4 | 4 | 4 | 5 |

Note:
*Comparison
Pigment 1: Calcined kaolin was coated with an epoxy resin
Pigment 2: Calcium carbonate was coated with a phenol resin
Pigment 3: Barium sulfate was coated with a melamine resin
Pigment 4: Calcium carbonate
Pigment 5: Calcined kaolin

EXAMPLE 6

In an autoclave were placed 30 parts by weight of butadiene, 10 parts by weight of styrene, 40 parts by weight of methyl methacrylate, 20 parts by weight of methacrylic acid, 2.0 parts by weight of an ammonium salt of lauryl alcohol sulfate, 0.5 part by weight of ammonium persulfate, 200 parts by weight of ion-exchanged water, and 0.5, 1.0, 1.5 or 2.0 parts by weight of tert.-dodecyl mercaptan, and the resulting mixture was subjected to polymerization at 60° C for 15 hours.

An electrostatic recording material was prepared in the same manner as in Example 1 by use of the thus obtained copolymer to obtain the results shown in Table 4. As is clear from Table 4, when the intrinsic viscosity [η] of the copolymer is more than 1.0 dl/g, the dispersibility of pigment is inferior.

Table 4

| Run No. | 1* | 2 | 3 | 4 |
|---|---|---|---|---|
| Tert.-dodecyl mercaptan (parts by weight) | 0.5 | 1.0 | 1.5 | 2.0 |
| Conversion (%) | 99 | 99 | 99 | 99 |
| Glass transition temp. (° C) | 25 | 25 | 25 | 25 |
| Intrinsic viscosity [η] (dl/g) | 1.39 | 1.00 | 0.52 | 0.38 |

Table 4-continued

| Run No. | 1* | 2 | 3 | 4 |
|---|---|---|---|---|
| Dispersibility of pigment | 1 | 3 | 5 | 5 |

Note:
*Comparison

EXAMPLE 7

The following experiments were conducted to examine the effect of the amount of alkenyl aromatic monomer (styrene) on the characteristics of electrostatic recording material.

In an autoclave were placed 100 parts by weight, in total, of the monomers shown in Table 5, 2.0 parts by weight of an ammonium salt of lauryl alcohol sulfate, 2.0 parts by weight of tert.-dodecyl mercaptan, 0.5 part by weight of ammonium persulfate, and 200 parts by weight of ion-exchanged water, and the resulting mixture was subjected to polymerization at 60° C for 18 hours.

By use of the thus obtained copolymer, an electrostatic recording material was prepared in the same manner as in Example 1, except that an edge runner type muller mixer was substituted for the mixer, to obtain the results shown in Table 5.

As is clear from Table 5, when the styrene content is less than 5% by weight, the recording characteristics are deteriorated, and when it is more than 50% by weight, the dispersibility of pigment is reduced.

Table 5

| Run No. | 1* | 2 | 3 | 4 | 5 | 6 | 7 | 8* |
|---|---|---|---|---|---|---|---|---|
| Monomer composition (% by weight) | | | | | | | | |
| Butadiene | 30 | 30 | 30 | 30 | 30 | 30 | 30 | 20 |
| Styrene | 0 | 5 | 10 | 20 | 30 | 40 | 50 | 60 |
| Methyl methacrylate | 50 | 45 | 40 | 30 | 20 | 10 | — | — |
| Methacrylic acid | 20 | 20 | 20 | 20 | 20 | 20 | 20 | 20 |
| Conversion (%) | 100 | 100 | 99 | 99 | 99 | 99 | 98 | 98 |
| Glass transition temperature (° C) | 25 | 25 | 25 | 24 | 24 | 24 | 24 | 49 |
| Intrinsic viscosity [η] (dl/g) | 0.39 | 0.38 | 0.38 | 0.39 | 0.42 | 0.45 | 0.42 | 0.38 |
| Dispersibility of pigment | 5 | 5 | 5 | 5 | 5 | 4 | 3 | 2 |
| Recording characteristics | 2 | 3 | 5 | 5 | 5 | 5 | 4 | 2 |
| Curl and fixing | 5 | 5 | 5 | 5 | 5 | 4 | 3 | 1 |
| Similarity to natural paper | 5 | 5 | 5 | 5 | 5 | 4 | 3 | 2 |
| Writability | 5 | 5 | 5 | 5 | 5 | 4 | 3 | 2 |

Note:
*Comparison

EXAMPLE 8

The following experiments were conducted in order to clarify the effect of the glass transition temperature of the copolymer.

In an autoclave were placed 100 parts by weight, in total, of the monomers shown in Table 6, 50 parts by weight of methanol and 4 parts by weight of azobisisobutyronitrile, and the resulting mixture was subjected to polymerization at 65° C for 24 hours. An appropriate amount of water and a 28% by weight ammonia water were added to the polymerization product to adjust the viscosity thereof to 1,000 cps and the solids concentration thereof to 20% by weight. By using the thus viscosity-adjusted polymerization product, an electrostatic recording material was prepared in the same manner as in Example 2 to obtain the results shown in Table 6.

As is clear from Table 6, when the glass transition temperature is more than 40° C, the curling and image-fixing properties are greatly deteriorated.

Table 6

| Run No. | 1 | 2 | 3 | 4 | 5 | 6 | 7 | 8* |
|---|---|---|---|---|---|---|---|---|
| Monomer composition (% by weight) | | | | | | | | |
| Butadiene | 30 | 40 | 40 | 25 | 30 | 25 | 25 | 20 |
| Styrene | 10 | 10 | 10 | 20 | 20 | 10 | 25 | 20 |
| Methyl methacrylate | 0 | 30 | 20 | 45 | 25 | 50 | 25 | 40 |
| Butyl methacrylate | 40 | 0 | 0 | 0 | 0 | 0 | 0 | 0 |
| Methacrylic acid | 20 | 20 | 30 | 20 | 25 | 15 | 25 | 20 |
| Conversion (%) | 98 | 98 | 98 | 100 | 98 | 100 | 100 | 100 |
| Glass transition temperature (° C) | 0 | 3 | 7 | 14 | 27 | 35 | 39 | 51 |
| Intrinsic viscosity [η] (dl/g) | 0.25 | 0.31 | 0.30 | 0.25 | 0.33 | 0.20 | 0.28 | 0.21 |
| Dispersibility of pigment | 5 | 5 | 5 | 5 | 5 | 5 | 5 | 5 |
| Recording characteristic | 5 | 5 | 5 | 5 | 5 | 5 | 5 | 5 |
| Curl and fixing | 5 | 5 | 5 | 5 | 5 | 4 | 3 | 1 |
| Similarity to natural paper | 5 | 5 | 5 | 5 | 5 | 5 | 5 | 5 |
| Writability | 5 | 5 | 5 | 5 | 5 | 5 | 5 | 5 |

Note:
*Comparison

EXAMPLE 9

An electrostatic recording material was prepared in the same manner as in Example 1, except that various wetting agents were added as surfactants and a conventional propeller mixer was used in place of mixing the hydrophobic pigment with the aqueous copolymer dispersion by means of a kneading mixer. The results obtained are shown in Table 7.

As is clear from Table 7, when no surfactant is used, the pigment cannot be dispersed at all. When the surface tension is reduced by adding the surfactant, the pigment is wetted and has a tendency to disperse. With an increase in the amount of the surfactant, the dispersibility of the pigment becomes good, but the electrical characteristics are deteriorated, and the recording characteristics of the resulting recording material are greatly deteriorated.

Table 7

| Surfactant | None | A | | | B | | | C | | |
|---|---|---|---|---|---|---|---|---|---|---|
| Proportion of surfactant added (%) | 0 | 0.2 | 2 | 5 | 0.2 | 2 | 5 | 0.2 | 2 | 5 |
| Dispersibility of pigment | Impossible | 1 | 2 | 4 | 1 | 2 | 4 | 1 | 2 | 3 |
| Recording characteristics | — | 1 | 2 | 1 | 1 | 2 | 1 | 1 | 2 | 1 |

Note:
1) Proportion of surfactant added is based on the weight of the hydrophobic pigment.
2) Surfactant A: Sodium dioctylsulfosuccinate
3) Sufractant B: Sodium alkylnaphthalenesulfonate
4) Surfactant C: Polyoxyethylene-octylphenyl ether

What is claimed is:

1. A process for producing an electrostatic recording material which comprises kneading a hydrophobic pigment having a critical surface tension of 50 dynes/cm or less with an aqueous dispersion of a copolymer consisting of (I) 10 to 50% by weight of methacrylic acid, (II) 5 to 50% by weight of an alkenyl aromatic compound and (III) 30 to 85% by weight of at least one member selected from the group consisting of conjugated diolefins, alkyl acrylates, and alkyl methacrylates; having a glass transition temperature (Tg) of 40° C or less; and having an intrinsic viscosity [$\eta$] of 0.1 to 1.0 dl/g as measured in tetrahydrofuran at 25° C, in a weight ratio of the copolymer to the pigment of 100/20 to 100/200, in the presence of an alkaline material in such a proportion that the viscosity of the aqueous dispersion of the copolymer becomes at least 350 cps, adjusting the viscosity of the aqueous dispersion containing the copolymer and the hydrophobic pigment to 10 to 5,000 cps, coating the resulting coating composition on the surface of an electroconductive base sheet and drying the same.

2. A process according to claim 1, wherein the alkenyl aromatic compound is selected from the group consisting of styrene, vinyltoluene, dimethylstyrene, halogenated styrene, and $\alpha$-methylstyrene.

3. A process according to claim 1, wherein the alkenyl aromatic compound is styrene.

4. A process according to claim 1, wherein the (III) member is selected from the group consisting of butadiene, isoprene, chloroprene, piperylene, cyclopentadiene, ethyl acrylate, butyl acrylate, methyl methacrylate and butyl methacrylate.

5. A process according to claim 1, wherein the (III) member comprises an alkyl acrylate or methacrylate having 1 to 12 carbon atoms in the alkyl group and butadiene.

6. A process according to claim 1, wherein the (III) member comprises methyl methacrylate and butadiene.

7. A process according to claim 1, wherein the proportion of methacrylic acid is 10 to 30% by weight.

8. A process according to claim 1, wherein the proportion of the alkenyl aromatic compound is 5 to 35% by weight.

9. A process according to claim 1, wherein the copolymer has an intrinsic viscosity [$\eta$] of 0.1 to 0.8 dl/g as measured in tetrahydrofuran at 25° C.

10. A process according to claim 1, wherein the copolymer is prepared by emulsion polymerization.

11. A process according to claim 1, wherein the copolymer is prepared by solution polymerization in a lower alkyl alcohol.

12. A process according to claim 1, wherein the proportion of the hydrophobic pigment is 40 to 150 parts by weight per 100 parts by weight of the copolymer.

13. A process according to claim 1, wherein the hydrophobic pigment is one obtained by treating a non-electrophoto-conductive inorganic fine powder with a natural or synthetic hydrophobic material.

14. A process according to claim 13, wherein the non-electrophoto-conductive fine powder is selected from the group consisting of silicic acid; silicates; polyvalent metal carbonates, polyvalent metal sulfates, polyvalent metal hydroxides, and polyvalent metal oxides; quartz sand; natural clay; and treated clay.

15. A process according to claim 13, wherein the hydrophobic material is selected from the group consisting of fats, rosin, shellac, salts of higher fatty acids, polyvinyl chloride, polyacrylates, polystyrene, polyethylene, silicone resins, phenol resins, urea resins, melamine resins, epoxy resins and alkyd resins.

16. A process according to claim 13, wherein the non-electrophoto-conductive fine powder is selected from the group consisting of silicic acid, a silicate, calcium carbonate, magnesium carbonate, barium sulfate, calcium sulfate, aluminum hydroxide, barium hydroxide, magnesium hydroxide, aluminum oxide, magnesium oxide, quartz sand, natural clay and calcined clay, and the hydrophobic material is selected from the group consisting of a fat, rosin, shellac, calcium oleate, magnesium stearate, polyvinyl chloride, polyacrylate, polystyrene, polyethylene, organopolysiloxane, phenol resin, urea resin, melamine resin, epoxy resin and alkyd resin.

17. A process according to claim 13, wherein the non-electrophoto-conductive fine powder is selected from the group consisting of calcium carbonate, barium sulfate, aluminum oxide, natural clay and calcined clay, and the hydrophobic material is an organopolysiloxane.

18. A process according to claim 1, wherein the alkaline material is selected from the group consisting of ammonia and primary, secondary and tertiary aliphatic amines and heterocyclic amines.

19. A process according to claim 1, wherein the alkaline material is selected from the group consisting of ammonia, ethylamine, propylamine, butylamine, diisopropylamine, triethylamine and morpholine.

20. A process according to claim 1, wherein the viscosity is adjusted to 500 to 8,000 cps by addition of an alkaline material.

21. A process according to claim 1, wherein the viscosity is adjusted to 1,000 to 5,000.

22. A process according to claim 1, wherein the base sheet is paper, a plastic sheet or a metal foil.

23. A process according to claim 1, wherein the base sheet is paper.

24. A process according to claim 1, wherein the base sheet has an electroconductivity corresponding to a surface resistivity of about $10^5$ to $10^{11}$ ohms at a relative humidity of 10 to 90%.

25. A process for producing an electrostatic recording material which comprises kneading a hydrophobic pigment having a critical surface tension of 50 dynes/cm or less and selected from the group consisting of a silicon resin-treated calcium carbonate, barium sulfate, aluminum oxide, natural clay and treated clay with an aqueous dispersion of a copolymer consisting of (I) 10 to 30% by weight of methacrylic acid, (II) 5 to 35% by weight of styrene and (III) 30 to 85% by weight combined of butadiene and methyl methacrylate; having a glass transition temperature (Tg) of 40° C or less; and having an intrinsic [$\eta$] of 0.1 to 0.8 dl/g as measured in tetrahydrofuran at 25° C, in a weight ratio of the copolymer to the pigment of 100/40 to 100/150, in the presence of ammonia in such a proportion that the viscosity of the aqueous dispersion of the copolymer is in the range of 1000–5000 cps, adjusting the viscosity of the aqueous dispersion containing the copolymer and the hydrophobic pigment to 10 to 5000 cps, coating the resulting coating composition on the surface of an electroconductive base sheet and drying the same.

* * * * *